US009410554B2

(12) United States Patent
Zhu et al.

(10) Patent No.: US 9,410,554 B2
(45) Date of Patent: Aug. 9, 2016

(54) CONTROLLING A GAS COMPRESSOR HAVING MULTIPLE MAGNETIC BEARINGS

(71) Applicant: Solar Turbines Incorporated, San Diego, CA (US)

(72) Inventors: Lei Zhu, San Diego, CA (US); Jason Wing-Bin Fong, San Diego, CA (US); David B. Jahnz, San Diego, CA (US); Roman Braunstein, San Diego, CA (US)

(73) Assignee: Solar Turbines Incorporated, San Diego, CA (US)

( * ) Notice: Subject to any disclaimer, the term of this patent is extended or adjusted under 35 U.S.C. 154(b) by 71 days.

(21) Appl. No.: 14/468,028

(22) Filed: Aug. 25, 2014

(65) Prior Publication Data

US 2015/0285242 A1 Oct. 8, 2015

Related U.S. Application Data

(60) Provisional application No. 61/975,466, filed on Apr. 4, 2014.

(51) Int. Cl.

| | |
|---|---|
| ***F04B 49/06*** | (2006.01) |
| ***F04D 29/058*** | (2006.01) |
| ***F04D 17/10*** | (2006.01) |
| ***F04D 17/12*** | (2006.01) |
| ***F04D 25/06*** | (2006.01) |

(52) U.S. Cl.

CPC ..... *F04D 29/058* (2013.01); *F04D 17/125* (2013.01); *F04D 25/06* (2013.01)

(58) Field of Classification Search

None

See application file for complete search history.

(56) References Cited

U.S. PATENT DOCUMENTS

| | | | |
|---|---|---|---|
| 4,114,960 | A | 9/1978 | Habermann et al. |
| 4,914,387 | A | 4/1990 | Santos |
| 5,578,880 | A | 11/1996 | Lyons et al. |
| 6,222,290 | B1 | 4/2001 | Schob et al. |
| 6,249,067 | B1 | 6/2001 | Schob et al. |

(Continued)

FOREIGN PATENT DOCUMENTS

| | | | |
|---|---|---|---|
| DE | 10 2005 032 675 | A1 | 1/2007 |
| WO | 2013152061 | A2 | 10/2013 |

OTHER PUBLICATIONS

Yates et al., "A Fault-Tolerant Multiprocessor Controller for Magnetic Bearings", IEEE Micro, Aug. 1988, pp. 6-17, University of Virginia.

(Continued)

*Primary Examiner* — Sean Shechtman

(74) *Attorney, Agent, or Firm* — Procopio, Cory, Hargreaves & Savitch LLP; James R. Smith

(57) ABSTRACT

A method for controlling a gas compressor is disclosed. The method includes communicating feedback data about two magnetic bearings to a computer including a multi-core processor via a communication link. The method also includes processing the feedback data about the two magnetic bearings where the feedback data for each of the two magnetic bearings is processed on separate cores of the multi-core processor in parallel and issuing a bearing control command to each of the two magnetic bearings in response to the feedback data. The method further includes communicating the bearing control commands to the two magnetic bearings from the computer via the communication link.

16 Claims, 4 Drawing Sheets

(56) References Cited

U.S. PATENT DOCUMENTS

| | | | | |
|---|---|---|---|---|
| 6,323,614 | B1 | 11/2001 | Palazzolo et al. | |
| 6,351,048 | B1 | 2/2002 | Schob et al. | |
| 6,515,387 | B1 | 2/2003 | Shinozaki | |
| 6,731,107 | B2 | 5/2004 | Reverdy | |
| 6,965,181 | B1 * | 11/2005 | Heshmat | F16C 17/024 310/90.5 |
| 7,441,442 | B2 | 10/2008 | Morgan | |
| 7,633,201 | B2 | 12/2009 | Buhler et al. | |
| 8,330,311 | B2 | 12/2012 | Ramsey et al. | |
| 2006/0055259 | A1 | 3/2006 | Hanlon et al. | |
| 2007/0246002 | A1 * | 10/2007 | Taniguchi | F04D 25/0606 123/246 |
| 2008/0307900 | A1 | 12/2008 | Paul et al. | |
| 2009/0009017 | A1 * | 1/2009 | Miyagawa | F04D 29/051 310/90.5 |
| 2010/0327687 | A1 | 12/2010 | Iannello et al. | |
| 2013/0268798 | A1 * | 10/2013 | Schade | G06F 11/1487 714/3 |
| 2013/0328455 | A1 | 12/2013 | Wu | |

OTHER PUBLICATIONS

Skadran, et al., "Supporting Higher-Order Controllers for Magnetic Bearings in a High-Speed, Real-Time Platform Using General-Purpose Computers", University of Virginia, FSM Labs, AFS Trinity Power, Inc., Oct. 2001, pp. 1-6.

* cited by examiner

CONTROLLING A GAS COMPRESSOR HAVING MULTIPLE MAGNETIC BEARINGS

CROSS-REFERENCE TO RELATED APPLICATIONS

The application claims the benefit of U.S. provisional patent application Ser. No. 61/975,466, filed Apr. 4, 2014, which is hereby incorporated by reference.

TECHNICAL FIELD

The present disclosure generally pertains to centrifugal gas compressors, and is more particularly directed toward a control system for magnetic bearings within an integrated motor driven centrifugal gas compressor.

BACKGROUND

Magnetic bearings are bearings that use electromagnetic forces to support a load. Magnetic bearings may support moving machinery without physical contact. For example, they can levitate a rotating shaft, providing for rotation with very low friction and no mechanical wear. Active magnetic bearings use electromagnetic suspension, and may include an electromagnet assembly, power amplifiers configured to drive the electromagnets, a controller, and sensors (e.g., gap sensors) with associated electronics. The power amplifiers drive electromagnets on opposing sides of the shaft. The sensors provide feedback to control the position of the rotor within the gap. The controller offsets the current to drive the electromagnets as the rotor deviates from its desired position.

U.S. Pat. No. 5,578,880 issued to Lyons et al. on Nov. 26, 1996 discloses a fault tolerant active magnetic bearing system that comprises a magnetic bearing having a rotor mounted for rotation within a stator and for coupling to a shaft. An electric power distribution system is energized from a multi-phase switched reluctance machine supplying three independent DC power buses. Each of the power buses is coupled for supplying power to a respective pair of diametrically opposite electromagnets of the magnetic bearing so as to establish multiple magnetic control axes. Multiple power controllers are each operatively connected in circuit with a separate respective power bus. The power controllers include independent power control systems each coupled to a respective pair of diametrically opposite electromagnets for independently controlling energization of each one of the pair of diametrically opposite electromagnets.

The present disclosure is directed toward overcoming one or more problems discovered by the inventors or that is known in the art.

SUMMARY OF THE DISCLOSURE

A method for controlling a gas compressor is disclosed herein. In one embodiment, the method includes communicating feedback data about two magnetic bearings to a computer including a multi-core processor via a communication link. The method also includes processing the feedback data about the two magnetic bearings where the feedback data for each of the two magnetic bearings is processed by different bearing control modules on separate cores of the multi-core processor in parallel and issuing a bearing control command to each of the two magnetic bearings in response to the feedback data. The method further includes communicating the bearing control commands to the two magnetic bearings from the computer via a communication link.

A control system for a centrifugal gas compressor is also disclosed herein, the centrifugal gas compressor including a compressor driver and a magnetic bearing system including a first magnetic bearing and a second magnetic bearing. In one embodiment, the control system includes a bearing input/output terminal, and a computer. The bearing input/output terminal includes an input/output device. The input/output device is configured to receive signals from a first sensor of the first magnetic bearing and a second sensor of the second magnetic bearing, and to transmit control commands to a first magnetic bearing driver of the first magnetic bearing and a second magnetic bearing driver of the second magnetic bearing.

The computer includes a multi-core processor, a first bearing control module, and a second bearing control module. The multi-core processor includes a first core and a second core. The first bearing control module is configured to process a first feedback signal from the first sensor on the first core and issue a first bearing control command to the first magnetic bearing driver. The second bearing control module is configured to process a second feedback signal from the second sensor on the second core and issue a second bearing control command to the second magnetic bearing driver in parallel to the first bearing control module.

DETAILED DESCRIPTION

The present disclosure relates to the control of a gas compressor having a magnetic bearing system including multiple magnetic bearings. In particular, the present disclosure relates to a control system and method of control where a computer, such as an industrial personal computer (PC), including a multi-core processor is configured to control the operation of two or more magnetic bearings in parallel operations with the multi-core processor. The multi-core processor may also be configured to control other systems of the gas compressor in parallel operations. In embodiments, a first core of the processor is configured to perform the calculations related to a first magnetic bearing, a second core of the processor is configured to perform the calculations related to a second magnetic bearing, and a third core of the processor is configured to control other systems of the gas compressor. Using separate cores for the calculations related to the first and second magnetic bearings may allow these calculations to be performed in parallel and may reduce delay in the system, which may provide for a more accurate and responsive control of the magnetic bearing system.

Figure 1:
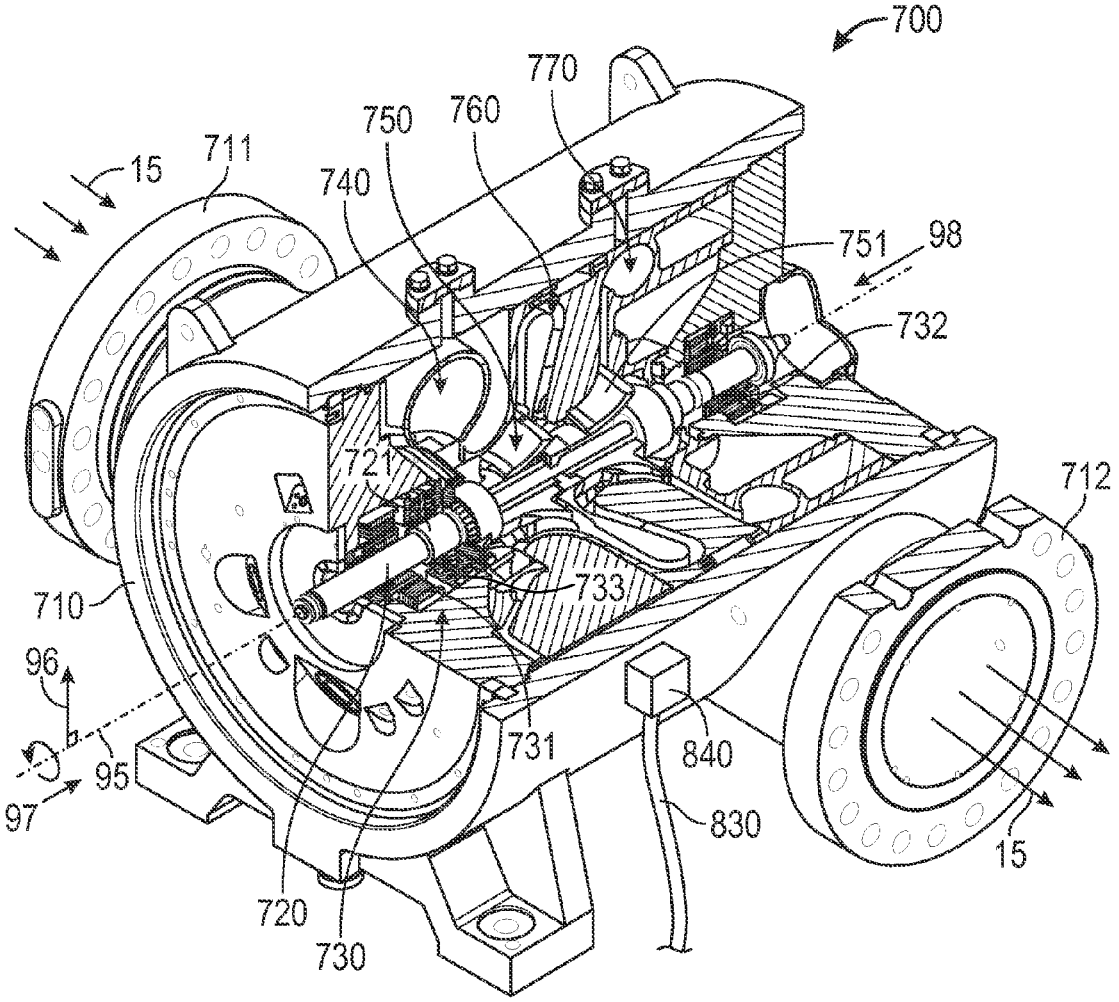
FIG. 1 is a cutaway illustration of an exemplary centrifugal gas compressor.

FIG. 1 is a cutaway illustration of an exemplary centrifugal gas compressor 700. Some of the surfaces have been left out or exaggerated (here and in other figures) for clarity and ease of explanation. In addition the centrifugal gas compressor 700 is shown in isolation from its driver and flow path.

This disclosure may generally reference a center axis 95 of rotation of the centrifugal gas compressor, which may be generally defined by the longitudinal axis of its compressor shaft 720. The center axis 95 may be common to or shared with various other concentric components of the centrifugal gas compressor. All references to radial, axial, and circumferential directions and measures refer to center axis 95, unless specified otherwise, and terms such as "inner" and "outer" generally indicate a lesser or greater radial distance from the center axis 95, wherein a radial 96 may be in any direction perpendicular and radiating outward from center axis 95.

In addition, this disclosure may reference a forward and an aft direction. Generally, all references to "forward" and "aft" are associated with the flow direction, relative to the center axis 95, of the compressed gas. In particular, the suction end 97 of the centrifugal gas compressor is referred to as the forward end or direction, and the discharge end 98 is referred to as the aft end or direction, unless specified otherwise.

The centrifugal gas compressor 700 includes a compressor housing 710, a suction port 711, discharge port 712, a compressor shaft 720, a compressor bearing system 730, an inlet 740, a rotor 750, a diffuser 760, and a collector 770. The rotor 750 may include one or more centrifugal impellers 751. The compressor shaft 720 may also include a suction end and a discharge end associated with the suction end 97 and the discharge end 98 of the centrifugal gas compressor 700. The compressor shaft 720 may be a single shaft or dual shaft configuration. In a dual shaft configuration, compressor shaft 720 may include a suction end stubshaft and a discharge end stubshaft.

The compressor shaft 720 and attached elements are supported by the compressor bearing system 730. In the embodiment illustrated, the compressor bearing system 730 includes three magnetic bearings, a suction end radial bearing 731, a discharge end radial bearing 732, and a thrust bearing 733. Suction end radial bearing 731 and discharge end radial bearing 732 are radial magnetic bearings and support axial ends of the compressor shaft 720. The thrust bearing 733 is an axial magnetic bearing and counteracts axial forces applied to the compressor shaft 720. In other embodiments, the compressor bearing system 730 includes more radial/axial magnetic bearings.

The radial magnetic bearings, such as suction end radial bearing 731 and discharge end radial bearing 732, are configured to magnetically levitate the compressor shaft 720 and the thrust bearing 733 is configured to maintain a thrust collar 721 within a gap in the thrust bearing 733. The compressor bearing system 730 is configured to operate with very low friction and little to no mechanical wear. Additionally, the compressor bearing system 730 may also include auxiliary or backup bearings.

During normal operation, the process gas 15 enters the centrifugal gas compressor 700 at the suction port 711 and is routed to the inlet 740. The process gas 15 is compressed by one or more centrifugal impellers 751 mounted to the compressor shaft 720, diffused by one or more diffusers 760, and collected by the collector 770. The compressed process gas 15 exits the centrifugal gas compressor 700 at a discharge port 712.

According to one embodiment, the process gas 15 may be controlled at or proximate the centrifugal gas compressor 700. In particular, one or more flow control devices may be integrated into the centrifugal gas compressor 700 as part of a compressor monitoring system. In addition, one or more flow control devices may be part of a process control system separate from the centrifugal gas compressor 700.

Moreover, the process gas 15 may be controlled and/or metered coming into or leaving the centrifugal gas compressor 700. This may include controlling gas flow, gas pressure, gas temperature, inlet pressure, outlet pressure, etc. For example, the centrifugal gas compressor 700 may be controlled with one or more valves (e.g., yard valves), or other flow metering devices, located proximate the suction port 711 and/or the discharge port 712. Also for example, the centrifugal gas compressor 700 may be controlled using one or more pressure regulators configured to regulate pressure of the process gas 15. Also for example, the centrifugal gas compressor 700 may be controlled with one or more temperature regulators (e.g., heat exchangers) configured to regulate the temperature of the process gas 15.

Figure 2:
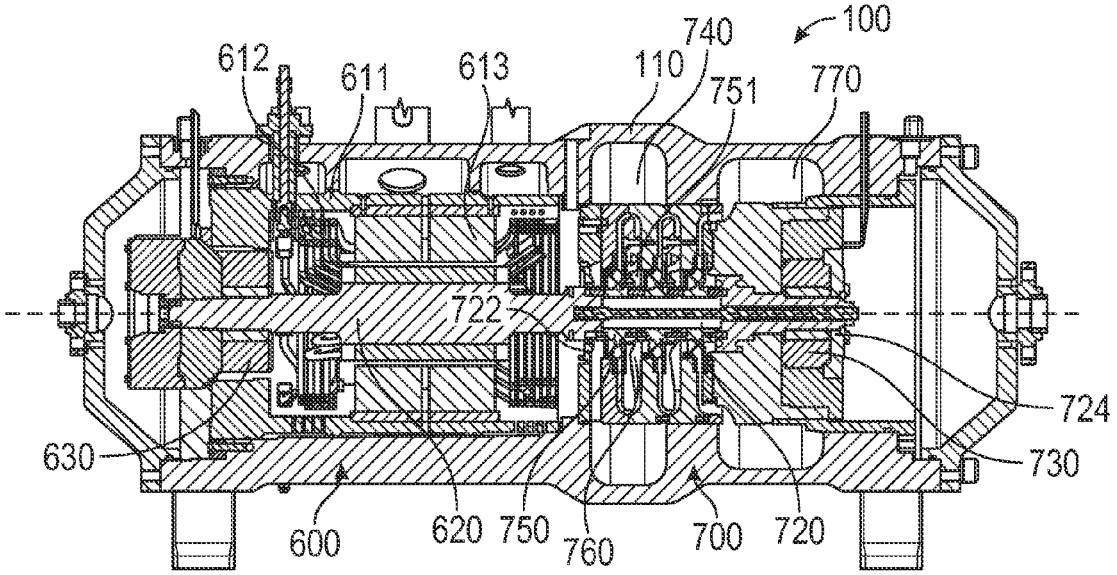
FIG. 2 is a cross-sectional view of an alternate embodiment of a centrifugal gas compressor within an integrated machine.

FIG. 2 is a cross-sectional view of an alternate embodiment of a centrifugal gas compressor 700 within an integrated machine 100. The integrated machine 100 includes the centrifugal gas compressor 700 and a compressor driver 600 within a single housing 110. The housing 110 may include a first end adjacent the compressor driver 600 and a second end adjacent the centrifugal gas compressor 700.

In the embodiment illustrated, the compressor driver 600 is an electric motor and includes a motor can 611, motor windings 612, motor laminations 613, and driver shaft 620. Motor can 611 may be cylindrically shaped and may be contained within housing 110. Motor windings 612 may be wound about driver shaft 620 at each end of motor can 611 and may extend through motor laminations 613. Motor laminations 613 may be centrally located within motor can 611 and may be located axially between the end windings of motor windings 612. Driver shaft 620 may extend through motor can 611.

The centrifugal gas compressor 700 within the integrated machine 100 also includes a compressor shaft 720, an inlet 740, an collector 770, a rotor 750 including centrifugal impellers 751, and diffusers 760, which may be the same or similar as those described in conjunction with FIG. 1.

In the embodiment illustrated, the compressor driver 600 is supported by a driver bearing system 630 and the centrifugal gas compressor is supported by a compressor bearing system 730; the driver bearing system 630 is distal to the centrifugal gas compressor, adjacent first end, and the compressor bearing system 730 is distal to the compressor driver 600, adjacent the second end.

In the embodiment illustrated, driver shaft 620 and compressor shaft 720 are joined by a tierod 724 and may not need a coupling. Driver shaft 620 and compressor shaft 720 may also be joined/bolted together by bolts 722, or by other coupling means.

Figure 3:
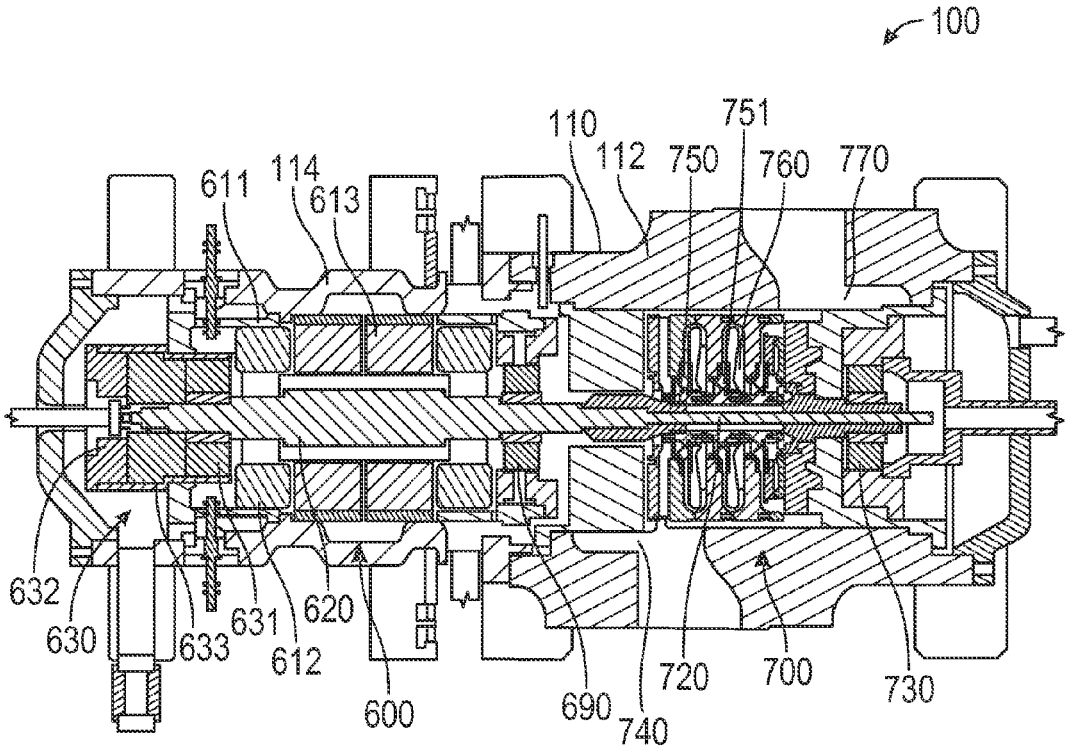
FIG. 3 is a cross-sectional view of an alternate embodiment of a centrifugal gas compressor within an integrated machine.

FIG. 3 is a cross-sectional view of an alternate embodiment of a centrifugal gas compressor 700 within an integrated machine 100. In the embodiment illustrated in FIG. 3, housing 110 includes a driver housing 114 and a compressor housing 112 coupled together to form housing 110. The driver shaft 620 extends at least partially through the driver housing 114 and is joined to compressor shaft 720, such as by a tierod.

In some embodiments, as illustrated in FIG. 3 driver bearing system 630 is a combination bearing including a driver magnetic bearing 631 and a second driver magnetic bearing 632 within a single bearing housing 633. In the embodiment illustrated, the driver magnetic bearing 631 is a radial bearing and the second driver magnetic bearing 632 is a thrust bearing. In the embodiment illustrated, compressor bearing system 730 is a single radial magnetic bearing. Driver bearing system 630 may be located adjacent the compressor driver 600 and distal to the centrifugal gas compressor 700, and compressor bearing system 730 may be located adjacent the centrifugal gas compressor 700 and distal to compressor driver 600.

The integrated machine 100 may also include a central bearing system 690 located between the compressor driver 600 and the centrifugal gas compressor 700. In the embodiment illustrated, central bearing system 690 is a single radial magnetic bearing.

Any of the bearing systems and any combination of the bearing systems within the integrated machine 100 including driver bearing system 630, compressor bearing system 730, and central bearing system 690 may be a combination bearing and may include a radial magnetic bearing and a thrust bearing within a single bearing housing 633.

Figure 4:
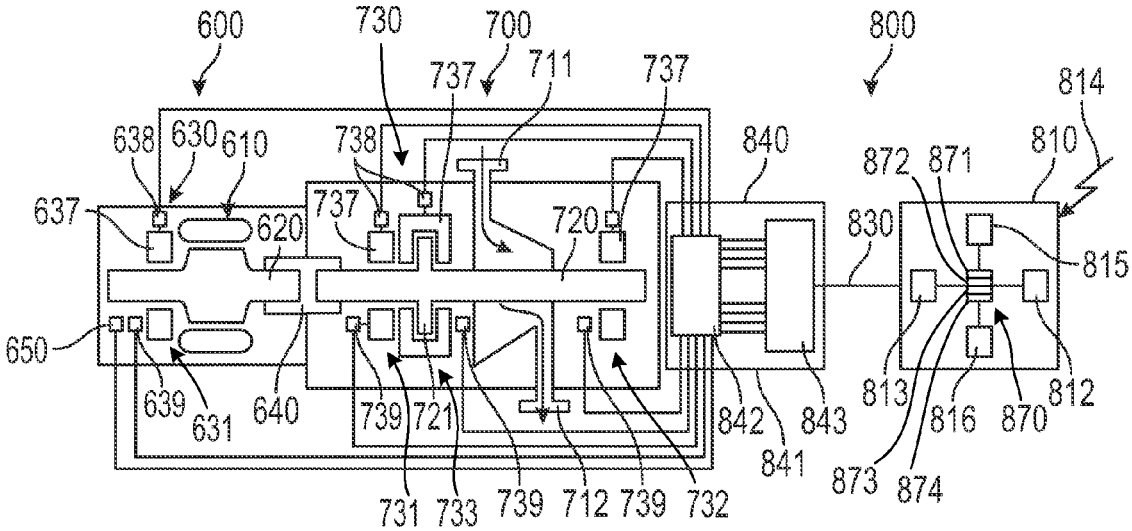
FIG. 4 is a block diagram of an exemplary system for controlling magnetic bearings in the centrifugal gas compressor of FIG. 1.

FIG. 4 is a block diagram of an exemplary system for controlling magnetic bearings in the centrifugal gas compressor 700 of FIG. 1. In particular, the control system 800 is shown along with the centrifugal gas compressor 700 and with a compressor driver 600. The control system 800 is configured for magnetic bearing control, but, as discussed below, may be configured for additional control functions. For clarity, single elements may be represented where multiple elements may be, and are used.

Regarding the centrifugal gas compressor 700, magnetic bearings in the centrifugal gas compressor 700, such as suction end radial bearing 731, discharge end radial bearing 732, and thrust bearing 733, may each include an electromagnet assembly 737, a magnetic bearing driver (e.g., a set of power amplifiers 738 configured to supply current to the electromagnets), and one or more sensors 739 with associated electronics to provide the feedback required to control the position of the levitated member (e.g., the compressor shaft 720 and/or the thrust collar 721) within the gap. One or more of the electromagnet assembly 737, the power amplifier 738, and the sensor 739 may be combined into a single device or shared with another device.

Regarding the compressor driver 600, the compressor driver 600 may be any device configured to drive the centrifugal gas compressor 700. In particular, the compressor driver 600 may be mechanically joined/coupled to the compressor shaft 720 of centrifugal gas compressor 700, and configured to transmit a driving torque. For example, the compressor driver 600 may be an electric motor, a gas turbine engine, a reciprocating engine, etc.

Moreover, the compressor driver 600 and the centrifugal gas compressor 700 may have any convenient configuration. For example, the compressor driver 600 and the centrifugal gas compressor 700 may have individual housings, a common housing as illustrated in FIG. 2, or a joined or partially shared housing as illustrated in FIG. 3. Similarly, the compressor driver 600 and the centrifugal gas compressor 700 may have separate joined drive shafts, a single or common shaft, or a combination thereof. Moreover, the compressor driver 600 and the centrifugal gas compressor 700 may have no shaft or only a partial shaft. For example, the one or more centrifugal impellers 751 (FIGS. 1 and 2) may be stacked together such that no shaft is needed there between. In some embodiments, the compressor driver 600 is integral to the centrifugal gas compressor 700 and is located between the suction end radial bearing 731 and the discharge end radial bearing 732.

As illustrated, the compressor driver 600 may include a driver motor 610, a driver shaft 620, a driver bearing system 630, a power output coupling 640, and a driver sensing system 650. Here, the driver motor 610 is embodied as an electric motor configured to apply torque to the driver shaft 620. The driver shaft 620 is mechanically coupled to the compressor shaft 720 of the centrifugal gas compressor 700 via the power output coupling 640. The driver shaft 620 may be entirely supported by the driver bearing system 630. Alternately, and as illustrated, the driver shaft 620 may be partially supported by the driver bearing system 630. In this configuration, the driver shaft 620 may then also be supported by the compressor bearing system 730 of the centrifugal gas compressor 700 via the power output coupling 640.

According to one embodiment, the driver bearing system 630 may include one or more driver magnetic bearings 631. The one or more driver magnetic bearings 631 are configured to levitate the driver shaft 620 and/or a thrust collar within a gap there between. Likewise, the driver magnetic bearings 631 may each include an electromagnet assembly 637, a magnetic bearing driver (e.g., a set of power amplifiers 638 configured to supply current to the electromagnets), and one or more sensors 639, one or more of which may be combined into a single device or shared with another device. Additionally, the driver bearing system 630 may also include auxiliary or backup bearings.

According to one embodiment, the magnetic bearings in the compressor driver 600 and the centrifugal gas compressor 700 may be controlled together. In particular, the control system 800 may be communicably coupled and configured to control at least two magnetic bearings of compressor bearing system 730, the driver bearing system 630, or any combination thereof. Moreover, the control system 800 may be configured to control both the driver bearing system 630 and the compressor bearing system 730 as a single magnetic bearing system. For example, the control system 800 may be configured to receive feedback from the sensors 639, 739 in both the driver bearing system 630 and the compressor bearing system 730, respectively. The control system 800 may be further configured to process the feedback, and then issue control commands to the power amplifiers 638, 738, in both the driver bearing system 630 and the compressor bearing system 730, respectively. In some embodiments, the control system 800 may also be configured to control other bearing systems, such as the central bearing system 690 illustrated in FIG. 3, and may be configured to control all of the bearing systems as a single magnetic bearing system. One or more of these bearing systems may be a combination bearing, such as the driver bearing system 630 illustrated in FIG. 3.

The control system 800 may include a computer 810, a communication link 830, and a bearing input/output ("I/O") terminal 840. In particular, the computer 810 is communicably coupled to the bearing I/O terminal 840 via the communication link 830. The bearing I/O terminal 840 is then communicably coupled to each magnetic bearing system to be controlled. In addition, the control system 800 may be dedicated to control of the magnetic bearing systems, or may also control other components and systems, as discussed herein.

The computer 810 may be any computer having real time control capability. In particular, the computer can include a multi-core processor 870, a memory 812, a communication device 813, a power supply 814, a user output 815 (e.g., a display), and a user input 816 (e.g., a keyboard). According to one embodiment, the computer 810 may be an industrial PC. For example, the computer 810 may be rack mountable (e.g., 19-inch (48.26 cm) or 23-inch (58.42 cm)) and in conformance with one or more industrial PC standards (e.g., EIA/ECA-310-E). Also for example, the computer 810 may be a ruggedized INTEL processor-based industrial PC. In addition, the computer 810 may be configured as a front-end to another control computer in a distributed processing environment. In addition, the computer 810 may be dedicated for control of the compressor bearing system 730 and/or the driver bearing system 630 ("the magnetic bearing system"), or shared with one or more additional control functions.

The multi-core processor 870 is a single computing component with at least two cores, a core being an independent central processing unit (CPU) configured to read and execute program instructions. In the embodiment illustrated, multi-core processor 870 includes four cores, a first core 871, a second core 872, a third core 873, and a fourth core 874. Other amounts of cores within multi-core processor 870, such as two, six, and eight cores, may also be used.

The multi-core processor 870 may include a general purpose multi-core processor or any multi-core processor capable of receiving data from the sensors, determining whether and what adjustment should be made to at least two magnetic bearings, and communicating any desired commands. A general-purpose multi-core processor can be a microprocessor, but in the alternative, the multi-core processor can be any processor, controller, microprocessor, or microcontroller with multiple cores. In embodiments, a combination of processors with at least one multi-core processor may also be used, where the multi-core processor is used to control at least two magnetic bearings.

The multi-core processor 870 is configured to control two or more magnetic bearings such that at least one core performs the calculations related to a first magnetic bearing, such as the suction end radial bearing 731, and another core performs the calculations related to a second magnetic bearing, such as the discharge end radial bearing 732. The multi-core processor 870 may also be configured to receive data from the two or more magnetic bearings or sensors. In particular, the multi-core processor 870 may be communicably coupled to the sensor(s) 639, 739 of the two or more magnetic bearings via the communication link 830. Likewise, the multi-core processor 870 may be configured to issue commands to the two or more of the magnetic bearings or their components. In particular, the multi-core processor 870 may be communicably coupled to the power amplifier(s) 638, 738 of the two or more magnetic bearings via the communication link 830.

The memory 812 may include RAM memory, flash memory, ROM memory, EPROM memory, EEPROM memory, registers, hard disk, a removable disk, a CD-ROM, video tape and/or any other form of machine or computer readable storage medium. According to one embodiment, the memory 812 may have a volatile memory storage capacity greater than 2 GB.

The multi-core processor 870 and the memory 812 are configured to work together to implement the functionality of the control system 800. In particular, the memory 812 can be coupled to the multi-core processor 870 such that the multi-core processor 870 can read information from, and write information to the storage medium. According to one embodiment, memory 812 is configured to record instructions for one or more modules of the control system 800.

The communication device 813 may include any piece of equipment, hardware, or software configured to move data to and from the computer 810. In particular, the communication device 813 is configured to transmit control commands from the multi-core processor 870 to the bearing I/O terminal 840 via the communication link 830. Also, the communication device 813 is configured to receive digital feedback signals from the bearing I/O terminal 840 via the communication link 830.

According to one embodiment, the communication device 813 may be configured for data packet communications across a communication network. In particular, the communication device 813 may be configured to communicate control commands and feedback data in accordance with a standardized fieldbus communication protocol. For example, the communication device 813 may be configured to communicate data across an Ethernet based communication network using standard IEEE 802.3 Ethernet frames. Also for example, the communication device 813 may be configured to communicate EtherCAT (Ethernet for Control Automation Technology) communications with the bearing I/O terminal 840. Furthermore, the communication device 813 and any associated hardware or software may be configured to operate as an EtherCAT master controller.

The communication device 813 may be embodied as a dedicated device, such as a network interface card, or may have shared or distributed functionality with other components of the computer 810. The communication device 813 may be configured for wired, wireless, and/or optical communications. Furthermore, the communication device 813 may be configured for full-duplex and/or half-duplex communications across one or more communication links 830.

The power supply 814 may include any hardware configured to supply power to the computer. In particular, the power supply 814 is configured to provide uninterrupted power during bearing operation. According to one embodiment, the power supply 814 may be configured to receive power from an uninterrupted power source (e.g., facility power) shared with one or more of the compressor driver 600, the centrifugal gas compressor 700, the electromagnet assemblies 637, 737, etc.

The communication link 830 may be any convenient link, including a wired, wireless, and/or optical link. The communication link 830 is configured to support digital communications between the computer 810 and bearing I/O terminal 840. For example, the communication link 830 may be use twisted-pair cables for the physical layer of an Ethernet computer network, or any other Ethernet compliant cable.

In addition, the communication link 830 may provide for the computer 810 to be located at a remote location as opposed to a DSP controller proximate or collocated with magnetic bearings. In particular, the communication link 830 may extend ten or more feet (>3 meters) between the bearing I/O terminal 840 and the computer 810. For example, the computer 810 may be located at user-friendly location, such as in a control room, while the communication link 830 extends back to the bearing I/O terminal 840. The bearing I/O terminal being in much closer proximity to the centrifugal gas compressor 700. This may be beneficial in that operators may have greater access to the controller in general and/or may access the controller without being exposed to the working machinery. In addition, greater resources may be available in the remote location, such as processors, communication networks, climate control, etc.

The bearing I/O terminal 840 may include a terminal housing 841, an I/O device 842, and a communication device 843. The terminal housing 841 may enclose the I/O device 842 and the communication device 843, which may be coupled to each other therein. In addition, the I/O device 842 and the communication device 843 may be embodied as two units, as a single unit, or have a distributed and/or shared architecture. According to one embodiment, the bearing I/O terminal 840 may be configured to receive power from or be powered by an uninterrupted power source. Moreover, the uninterrupted power source may be common or shared with the computer 810.

The bearing I/O terminal 840 may be fixed to, within or located proximate the centrifugal gas compressor 700 (such as in a control cabinet of the centrifugal gas compressor 700).

Where the terminal housing 841 is located in or on the centrifugal gas compressor 700, it may be sealed or otherwise include additional environmental protections.

In general, the bearing I/O terminal 840 is configured as a communication conduit between the computer 810 and the magnetic bearings. In particular, the bearing I/O terminal 840 may be communicably coupled to components/systems of the magnetic bearings via the I/O device 842. For example the I/O device 842 may be wired to the electromagnet assemblies 637, 737, the power amplifiers 638, 738, and the sensors 639, 739.

The I/O device 842 may be configured to receive signals from sensor(s) 639, 739 of two or more magnetic bearings, and further configured to transmit control commands to the power amplifier(s) 638, 738 of two or more magnetic bearings. In particular, the I/O device 842 may include any convenient device of any architecture/distribution that is configured to perform analog-to-digital (A/D) conversion, digital-to-analog (D/A) conversion, signal sampling, electronic filtering and/or other signal conditioning. For example, the I/O device 842 may include an A/D converter configured to digitize signals from the at least one sensor 639, 739 of the magnetic bearing system or other devices of the compressor driver 600 and/or the centrifugal gas compressor 700. Similarly, the input/output device 842 may include a D/A converter configured to convert control commands to analog signals for the power amplifiers 638, 738 of the magnetic bearings. Also for example, the bearing I/O terminal 840 may be embodied as an ASIC interfaced with the sensors 639, 739, power amplifiers 638, 738 and/or other devices.

The communication device 843 may include any piece of equipment, hardware, or software configured to move data to and from the bearing I/O terminal 840. In particular, the communication device 843 is configured to transmit digital feedback signals from the I/O device 842 to the computer 810 via the communication link 830. Also, the communication device 843 is configured to receive control commands from the computer 810 via the communication link 830. According to one embodiment, the communication device 813 of the computer 810 and the communication device 843 of the bearing I/O terminal 840 are configured to communicate with an input/output delay of less than 60 microseconds.

Like the communication device 813 of the computer 810, the communication device 843 of the bearing I/O terminal 840 may be configured for data packet communications across a communication network. In particular, the communication device 843 may be configured to communicate control commands and feedback data in accordance with a standardized fieldbus communication protocol. For example, the communication device 843 may be configured to communicate data across an Ethernet based communication network using standard IEEE 802.3 Ethernet frames. Also for example, the communication device 843 may be configured to communicate EtherCAT (Ethernet for Control Automation Technology) communications with the computer 810. Unlike the communication device 813 of the computer 810, however, the communication device 843 may be configured as an EtherCAT slave controller communicably coupled to devices such as sensors 639, 739 and power amplifiers 638, 738 via the I/O device 842.

The communication device 843 of the bearing I/O terminal 840 may be embodied as a dedicated device, such as ASIC, or may have shared or distributed functionality with other components of the bearing I/O terminal 840. The communication device 843 may be configured for wired, wireless, and/or optical communications. Furthermore, the communication device 843 may be configured for full-duplex and/or half-duplex communications across one or more communication links 830.

According to one embodiment, communication device 843 may be configured to selectively communicate data. In particular, the communication device 843 may be configured to communicate different classes of data separately. For example, classes of data may be distinguished by data source (e.g., control commands from the computer 810 versus feedback data from sensors 639, 739). Also for example, multiple classes of data may be used. According to one embodiment, distinct data classes may be provided for: feedback from each magnetic bearing, control commands to each magnetic bearing, environmental data, and data associated with other devices or systems (discussed below).

In selectively communicating data, the communication device 843 may be configured to selectively communicate data within data packets at separate times. In particular, the communication device 843 may communicate a first data packet for a first class of data and second data packet for a second class of data. For example, the communication device 843 may be configured to communicate a first data packet for feedback signals and second data packet for control commands. Also for example, in the EtherCAT configuration, the EtherCAT telegram may only include updates to Datagrams from a first class of signal (e.g., feedback signals) or to Datagrams from a second class of signal (e.g., control commands) but not to both at the same time. Thus, the communication device 843 is configured to selectively communicate a first and a second EtherCAT telegram with either a first set of Datagrams based on a first class of signal or with a second set of Datagrams based on a second class of signal, respectively.

According to one embodiment the EtherCAT telegram may be reduced in size to reflect only one class of data traveling at a time. In particular, the communication device 843 may be configured to alternate signal classes in one or more shared Datagrams.

Figure 5:
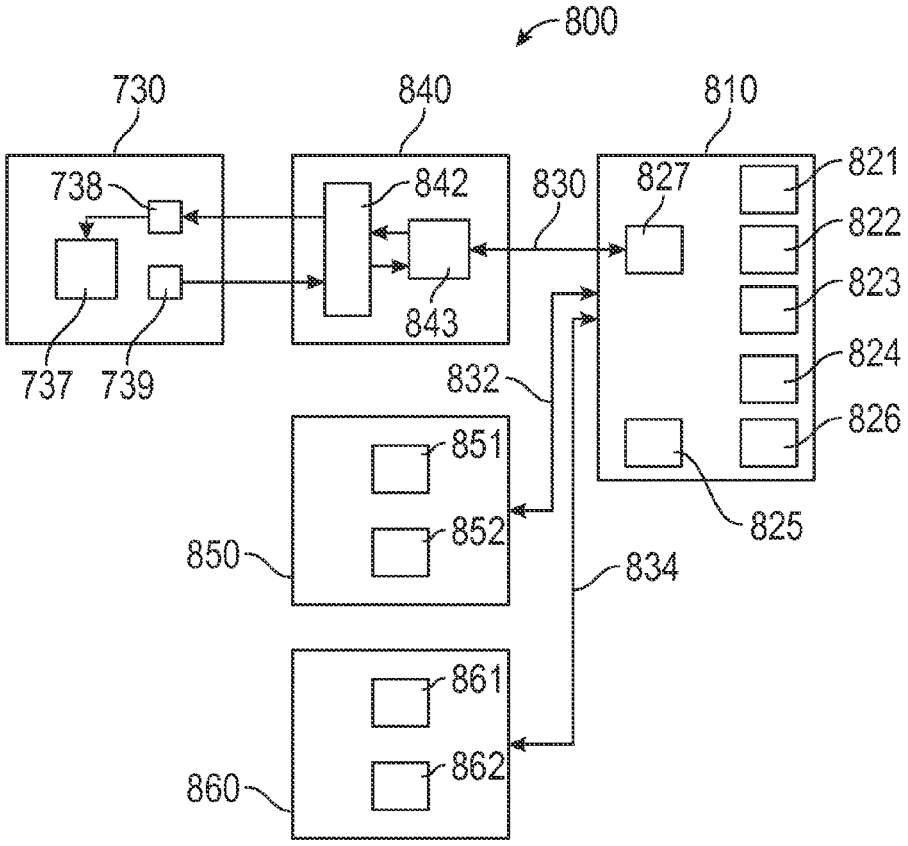
FIG. 5 is a functional block diagram of an exemplary system for controlling the centrifugal gas compressor of FIG. 1.

FIG. 5 is a functional block diagram of an exemplary system for controlling the centrifugal gas compressor of FIGS. 1-3. In the embodiment illustrated, the control system 800 for the magnetic bearing system is shown configured to also include control functionality for the centrifugal gas compressor 700 and the compressor driver 600. While the control system 800 may control a driver bearing system 630, a central bearing system 690, and a compressor bearing system 730 together, for convenience only a compressor bearing system 730 is illustrated.

The control system 800 includes the computer 810, the communication link 830, and the bearing I/O terminal 840 described above. In addition, the control system 800 may include a compressor I/O terminal 850 and a driver I/O terminal 860. The compressor I/O terminal 850 and a driver I/O terminal 860 may be communicably coupled to the computer 810 via a compressor communication link 832 and a driver communication link 834. The compressor communication link 832 and/or the driver communication link 834 may be separate from, or integrated with each other. Furthermore, the compressor communication link 832 and/or the driver communication link 834 may be separate from or integrated with the communication link 830 to the bearing I/O terminal 840.

The compressor I/O terminal 850 is communicably coupled to the centrifugal gas compressor 700. The compressor I/O terminal 850 may be fixed to, located within, or located proximate the centrifugal gas compressor 700 (such as in a control cabinet of the centrifugal gas compressor 700). Where the compressor I/O terminal 850 is located in or on the centrifugal gas compressor 700, it may be sealed or otherwise include additional environmental protections.

The driver I/O terminal 860 is communicably coupled to the compressor driver 600. The driver I/O terminal 860 may be fixed to, located within, or located proximate the compressor driver 600 (such as in a control cabinet of the compressor driver 600 and or/the centrifugal gas compressor 700). Where the driver I/O terminal 860 is located in or on the compressor driver 600, it may be sealed or otherwise include additional environmental protections.

The compressor I/O terminal 850 may include a compressor I/O module 851 and a compressor communication module 852. The compressor I/O module 851 and the compressor communication module 852 may be communicably coupled to each other, and may be configured as a communication conduit between the computer 810 and the centrifugal gas compressor 700. In particular, the compressor I/O module 851 may be communicably coupled to one or more components/systems of the centrifugal gas compressor 700 and the compressor communication module 852 may be communicably coupled to the computer 810. In addition, the compressor I/O module 851 and the compressor communication module 852 may be embodied as two units, as a single unit, or have a distributed and/or shared architecture.

According to one embodiment, the compressor I/O module 851 may be configured to communicate signals with one or more compressor sensors (e.g., measuring valve position, inlet/outlet pressure, gas flow rate, temperature, heat exchanger status, etc.). Also for example, the compressor I/O module 851 may be configured to communicate commands to one or more flow control devices (described above), or other devices configured to control flow to and/or from the centrifugal gas compressor 700. In addition, the flow control device may include sensors configured to provide feedback regarding the flow metering device (e.g., inlet/outlet pressure, flow rate, temperature, etc.) to the compressor I/O module 851. The compressor I/O module 851 and the compressor communication module 852 may be embodied as an ASIC, interfaced with one or more sensors, flow metering device and/or other devices.

The driver I/O terminal 860 may include a driver I/O module 861 and a driver communication module 862. The driver I/O module 861 and the driver communication module 862 may be communicably coupled to each other, and may be configured as a communication conduit between the computer 810 and the compressor driver 600. In particular, the driver I/O module 861 may be communicably coupled to one or more components/systems of the compressor driver 600 and the driver communication module 862 may be communicably coupled to the computer 810. In addition, the driver I/O module 861 and the driver communication module 862 may be embodied as two units, as a single unit, or have a distributed and/or shared architecture.

According to one embodiment, the driver I/O module 861 may be configured to communicate signals with one or more driver sensors (e.g., measuring power, power bus voltage, power bus current, temperature, torque, rotational speed, etc.). Also for example, the driver I/O module 861 may be configured to communicate commands to a local controller such as a variable-frequency drive (VFD), or other devices configured to provide power management and control for the compressor driver 600. Accordingly, driver I/O module 861 may be configured to operate the local controller rather than the compressor driver 600 directly. The driver I/O module 861 and the driver communication module 862 may be embodied as an ASIC, interfaced with one or more sensors, a local controller of the compressor driver 600, and/or with other devices.

Returning to the computer 810 described above, the computer 810 may further include one or more modules configured to control each magnetic bearing, all or part of the centrifugal gas compressor 700, and all or part of the compressor driver 600. In particular, the computer 810 includes at least two bearing control modules. In the embodiment illustrated in FIG. 5, the computer includes a first bearing control module 821, a second bearing control module 822, a third bearing control module 823, and a fourth bearing control module 824. Each bearing control module may be configured to control one or more magnetic bearings. In one embodiment, the first bearing control module 821 is configured to control a first magnetic bearing, the second bearing control module 822 is configured to control a second magnetic bearing, the third bearing control module 823 is configured to control a third magnetic bearing, and the fourth bearing control module 824 is configured to control a fourth magnetic bearing. Each bearing control module may be configured to provide conventional automated operation processing control ("control algorithms") of their respective magnetic bearing.

The magnetic bearings may be radial or thrust magnetic bearings, such as those described in FIGS. 1-4. In some embodiment, the first magnetic bearing, the second magnetic bearing, and the third magnetic bearings are radial magnetic bearings, while the fourth magnetic bearing is a thrust magnetic bearing. In one of these embodiments, the fourth magnetic bearing and one of the first magnetic bearing, the second magnetic bearing, and the third magnetic bearing are within a single bearing housing forming a combination bearing.

In the embodiment illustrated in FIG. 5, the computer 810 also includes a compressor control module 825, a driver control module 826, and a communication module 827. The compressor control module 825, and/or the driver control module 826 ("control modules") may be configured to provide control algorithms of their respective systems. Control algorithms are generally known in the art for controlling magnetic bearings, as well as centrifugal gas compressors and driver motors. Similarly, the communication module 827 may be configured to provide conventional communications between the bearing control modules/control modules, and the bearing I/O terminal 840, the compressor I/O module 851, and the driver I/O module 861 ("I/O terminals"). In addition, the control modules may be configured to allow user control to and/or provide user feedback from the I/O terminals.

According to one embodiment, the bearing control modules and the control modules may be configured to communicate with each other. In particular, feedback and/or control commands may be shared amongst the bearing control modules and the control modules. For example, feedback directed toward the compressor control module 825 (e.g., valve position, inlet/outlet pressure, gas flow rate, temperature, heat exchanger status, etc.) may be shared with the each bearing control module. Also for example, feedback directed toward the driver control module 826 (e.g., power, power bus voltage, power bus current, temperature, torque, rotational speed, etc.) may be shared with each bearing control module. Similarly, feedback directed toward the control modules may be shared with the compressor control module 825 and the driver control module 826.

According to one embodiment, the bearing control modules/control modules may be further configured to use data from another module in its own control algorithms. In particular, the shared feedback and/or control commands from one control module may be used to modify commands of another control module. For example, the third bearing control module 823 may be configured to use pressure sensor feedback directed toward compressor control module 825, or a determination from the compressor control module 825 indicating aerodynamic loading of the rotor 750, to offset or otherwise adjust a control command to the thrust bearing 733.

The multi-core processor 870 and the at least two bearing control modules are configured such that the calculations required to control two magnetic bearings are performed in parallel on different cores of the multi-core processor 870. Each of the two or more bearing control modules can be configured to be implemented or performed with one of the cores of the multi-core processor 870. The control modules and the communication module 827 may be configured to be implemented or performed with a core not used by the bearing control modules or may be divided amongst the cores with portions of each being implemented or performed on the various cores. In one embodiment, the first bearing control module 821 is configured to control and perform the calculations for the suction end radial bearing 731, and is implemented or performed on the first core 871; the second bearing control module 822 is configured to control and perform the calculations for the discharge end radial bearing 732, and is implemented or performed on the second core 872; the third bearing control module 823 is configured to control and perform the calculations for the driver magnetic bearing 631 and is implemented or performed on the third core 873; the control modules and the communication module 827 are implemented or performed on the fourth core 874; and the fourth bearing control module 824 is configured to control and perform the calculations for the thrust bearing 733 and is implemented or performed on one or more of the first core 871, the second core 872, the third core 873, and the fourth core 874.

The fourth bearing control module 824 along with the other module operating on the one or more shared cores may be threaded and optimized to reduce any time delay in the calculations. In yet other embodiments including a fourth magnetic bearing, the multi-core processor 870 may be configured with an additional one or more cores to control and perform the requisite calculations for the fourth magnetic bearing on a separate core. Embodiments including any additional magnetic bearings or including a smaller number of cores may be implemented in a similar manner.

Figure 6:
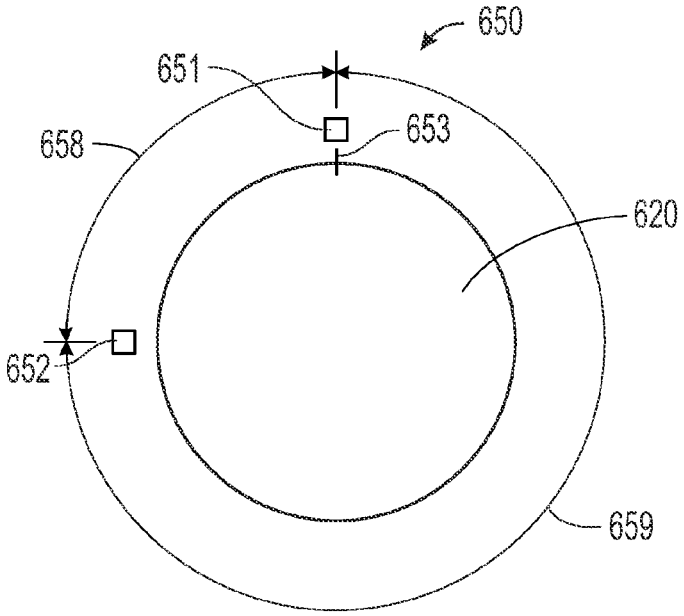
FIG. 6 is a schematic illustration of an embodiment of the driver sensing system of FIG. 2.

In some embodiments, such as when the compressor driver 600 is a motor, it may be desirable to determine the speed of the driver shaft 620 as well as the direction of rotation of the driver shaft 620. FIG. 6 is a schematic illustration of an embodiment of the driver sensing system 650 of FIG. 4. In the embodiment illustrated, the driver sensing system 650 includes a first driver sensor 651, a second driver sensor 652, and a sensed feature 653. First driver sensor 651 and second driver sensor 652 are offset and adjacent driver shaft 620. First driver sensor 651 and second driver sensor 652 are radially spaced apart such that a first angle 658 between the sensors is not equal to a second angle 659 between the sensors. First driver sensor 651 and second driver sensor 652 are each configured to detect the sensed feature 653. The sensed feature 653 is a feature detectable by the sensors, such as a notch or a protrusion.

In the embodiment illustrated, the driver sensing system 650 may determine the direction based on the difference in time it takes the sensed feature 653 to travel a first time from the first driver sensor 651 to the second driver sensor 652 and a second time from the second driver sensor 652 to the first driver sensor 651. If the first time is less than the second time, the driver shaft 620 is rotating in a first direction, and if the first time is greater than the second time, the driver shaft 620 is rotating in a second direction, opposite the first direction. More sensors may also be used provided that the angle between two adjacent sensors is different than all of the other angles between adjacent sensors.

In other embodiments, the driver sensing system 650 may include a single driver sensor with multiple sensed features 653, such as three sensed features 653, unequally spaced about driver shaft 620. If the unequal spaces are detected in a first order, the driver shaft 620 is rotating in the first direction, while if the unequal spaces are detected in a second order, the driver shaft 620 is rotating in the second direction.

INDUSTRIAL APPLICABILITY

The present disclosure generally applies to a control system in an industrial gas compressor. The described embodiments are not limited, however, to use in conjunction with a particular type of gas compressor (e.g., centrifugal, axial, etc.). Gas compressors such as centrifugal gas compressors are used to move process gas from one location to another. Centrifugal gas compressors are often used in the oil and gas industries to move natural gas in a processing plant or in a pipeline. Centrifugal gas compressors are driven by gas turbine engines, electric motors, or any other power source.

In some instances, embodiments of the presently disclosed control system are applicable to the use, operation, maintenance, repair, and improvement of centrifugal gas compressors, and may be used in order to improve performance and efficiency, decrease maintenance and repair, and/or lower costs. In addition, embodiments of the presently disclosed control system 800 may be applicable at any stage of the centrifugal gas compressor's life, from design to prototyping and first manufacture, and onward to end of life. Accordingly, control system 800 may be used in conjunction with a retrofit or enhancement to existing centrifugal gas compressors, as a preventative measure, or even in response to an event.

There is a desire to achieve greater efficiencies and reduce emissions in large industrial machines such as centrifugal gas compressors. Installing magnetic bearings in a centrifugal gas compressor may accomplish both desires. Centrifugal gas compressors may achieve greater efficiencies with magnetic bearings by eliminating any contact between the bearings and rotary element. Contact between the bearings and the rotary element generally causes frictional losses to occur. Magnetic bearings may use electromagnetic forces to levitate and support the rotary element without physically contacting the rotary, element eliminating the frictional losses.

Using magnetic bearings may reduce or eliminate production of undesirable emissions. These emissions may be produced by leaking or burning a lubricant such as oil. Eliminating the contact and frictional losses between the rotary element and bearings by supporting the rotary element with magnetic bearings may eliminate or reduce the need for lubricants in centrifugal gas compressors. With this elimination or reduction of lubricants or oil, the emissions in centrifugal gas compressors may be reduced or eliminated. Eliminating lubricants may also eliminate the need for the valves, pumps, filters, and coolers associated with lubrication systems.

Control of magnetic bearings in an industrial compressor requires high speed communications between feedback sensors and the controller. In particular, excessive input-to-output delays may lead to phase lag, which may lead to reduced damping. PC control may provide for previously unseen benefits.

Control of each magnetic bearing may require complex calculations. Performing all of the magnetic bearing calculations in series may cause delays from receipt of the feedback signal from a magnetic bearing to the transmission of the control signal to the magnetic bearing, which may further lead to phase lag and reduced damping. Using a multi-core processor to perform the calculations of two or more magnetic bearings in parallel may reduce the time delays and the phase lag, and improve damping.

Figure 7:
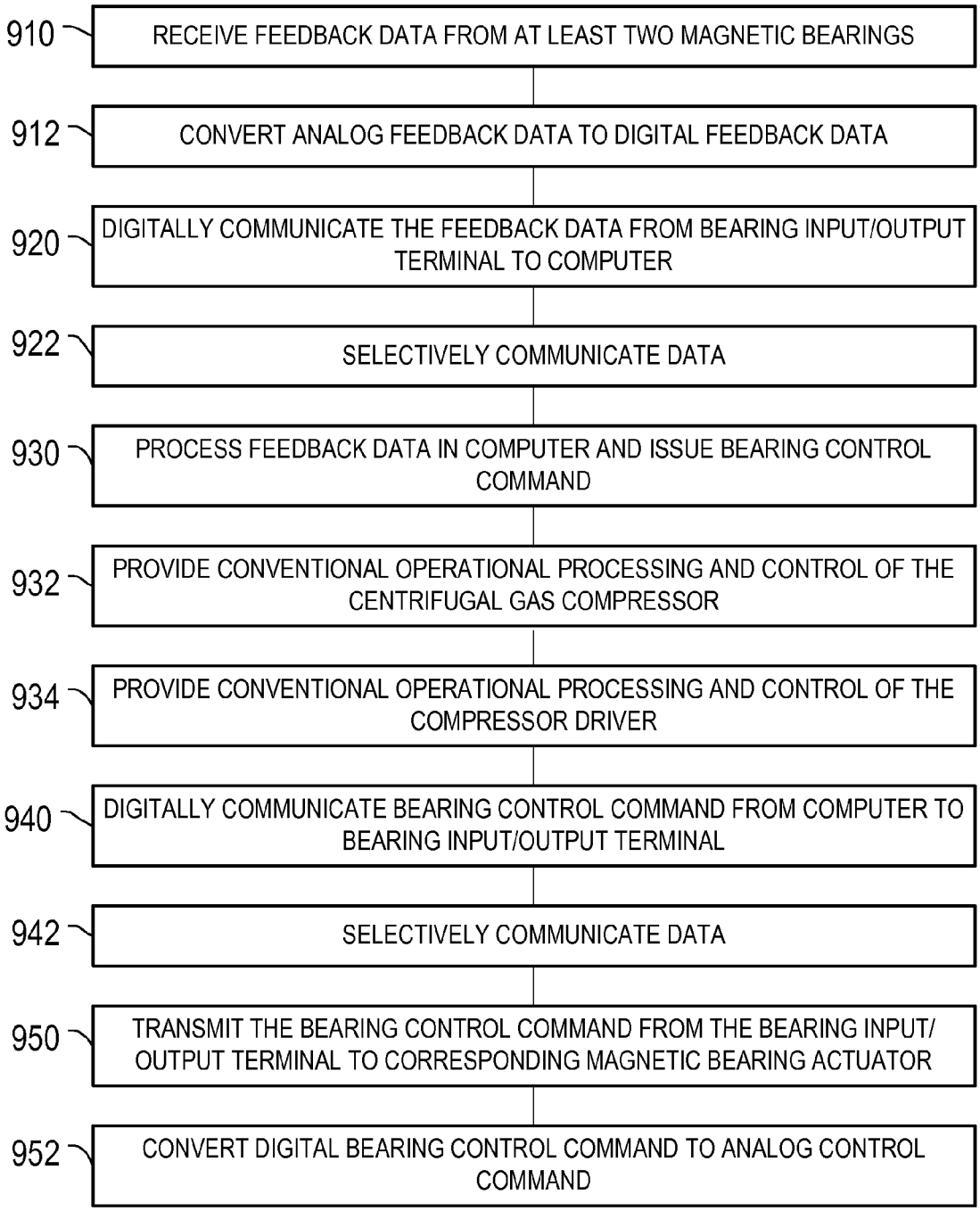
FIG. 7 is a flow chart of an exemplary method for controlling magnetic bearings in the centrifugal gas compressor of FIG. 1.

FIG. 7 is a flow chart of an exemplary method for controlling the centrifugal gas compressor of FIGS. 1, 2, and 3. The centrifugal gas compressor 700, the compressor driver 600, and particularly the driver bearing system 630, the central bearing system 690, and the compressor bearing system 730 can be controlled by a computer 810 with one or more of the following steps of a method 900, with reference to FIG. 1-6. The steps of method 900 may be performed in the order presented or out of the order presented. In addition, the steps of method 900 may be performed in parts. For example, one step may be performed in part, followed by one or more subsequent steps, and then completed.

In step 910, the bearing I/O terminal 840 receives feedback data about at least two magnetic bearings. In particular, the I/O device 842 may receive feedback data from multiple sources over multiple inputs. The feedback data may be in any form of signal (e.g., analog, digital, optical, etc.). Also, the feedback data may be from at least one sensor 639, 739 of each of the magnetic bearings or other source(s).

For example, the bearing I/O terminal 840 may receive feedback data from the suction end radial bearing 731 and the discharge end radial bearing 732, and more particularly from the sensor(s) 739 of the suction end radial bearing 731 and the discharge end radial bearing 732. Also for example, sensor input corresponding to the compressor shaft 720 and/or other rotating members, such as the driver shaft 620 (e.g., position, speed, rotational direction, vibration, angle, etc.) may be received. Also for example, ancillary input corresponding to environmental conditions (e.g., temperature, available power, etc.), compressor performance (e.g., compressor supply, compressor demand, compressor output, etc.), bearing performance (e.g., current, voltage, applied force, etc.), and other ancillary input may be received.

In step 912, the bearing I/O terminal 840 may convert analog feedback data to digital feedback data. In particular, the I/O device 842 may perform A/D conversion, signal sampling, electronic filtering and/or other signal conditioning. In addition, the I/O device 842 may include one or more digital inputs and communicate digitally inputted feedback data along with converted digital feedback data.

In step 920, the bearing I/O terminal 840 digitally communicates the feedback data to the computer 810. In particular, the communication device 843 may transmit digital feedback signal from the I/O device 842 to the computer 810 via the communication link 830. For example, the communication device 843 may communicate feedback data across an Ethernet based communication network. Also for example, the communication device 843 may communicate the feedback data to the computer 810 in accordance with a standardized fieldbus communication protocol, such as EtherCAT.

In step 922, the bearing I/O terminal 840 may selectively communicate data. In particular, the communication device 843 may communicate different classes of data on separate paths. For example, the communication device 843 may communicate an EtherCAT telegram with either a first set of Datagrams based on a first class of signal or with a second set of Datagrams based on a second class of signal. Step 922 may further include creating and/or identifying one or more classes of data as discussed above. According to one embodiment, digitally communicating the feedback data from the bearing input/output terminal to a computer may include selectively communicating the feedback data.

In step 930, the computer 810 processes the feedback data and issues bearing control commands. In particular, the computer 810 processes the feedback data about at least two magnetic bearings with the feedback data for each of the two magnetic bearings being processed by a different bearing control module on a different core of the multi-core processor 870. For example, the computer 810 may process first feedback data from a first sensor about a first bearing using a first bearing control module 821 on a first core 871 of the multi-core processor 870 and issues a first bearing control command to a first magnetic bearing driver, and processes second feedback data from a second sensor about a second bearing using a second bearing control module 822 on a second core 872 of the multi-core processor 870 and issues a second bearing control command to a second magnetic bearing driver. Similarly, the computer 810 may process third feedback data from a third sensor about a third bearing using a third bearing control module 823 on a third core 873 of the multi-core processor 870 and issues a third bearing control command to a third magnetic bearing driver. Further, the computer 810 may process fourth feedback data from a fourth sensor about a fourth bearing using a fourth bearing control module 824 on a fourth core 874 of the multi-core processor 870 and issues a fourth bearing control command to a fourth magnetic bearing driver. In some embodiments, the fourth core 874 may be primarily dedicated to other processes, such as conventional operational processing and control of the centrifugal gas compressor 700 and the compressor driver 600 (as described below with reference to steps 932 and 934). In such embodiments, the computer 810 may process the feedback data about the fourth bearing using the fourth bearing control module 824 on one or more cores of the multi-core processor 870 and may be divided amongst numerous cores of the multi-core processor 870, such as the first core 871, the second core 872, the third core 873, and the fourth core 874.

Each bearing control module may provide conventional operational processing and control of its corresponding magnetic bearing by performing calculations on its corresponding core based on the feedback data about its corresponding magnetic bearing. For example, using its corresponding core of the multi-core processor 870, one of the bearing control modules may issue commands directing the power amplifier 738 of its corresponding magnetic bearing to increase or decrease magnetic attraction of the levitated member along one or more axes. In addition, using its corresponding core of the multi-core processor 870, one of the bearing control modules may calculate bearing control commands based on the feedback received from its corresponding magnetic bearing, preset data libraries, and/or adaptive learning. Furthermore, the multi-core processor 870 may calculate bearing control commands based on a minimum 10 kHz sample rate (100 microseconds scan time), and/or on a 60 microsecond input-to-output delay. Dedicated assignment for magnetic bearing control on parallel cores may reduce delays and improve system performance.

In step 932, the computer 810 may provide conventional operational processing and control of the centrifugal gas compressor 700, for example, in the compressor control module 825. Similarly, in step 934, the computer 810 may provide conventional operational processing and control of the compressor driver 600, for example, in the driver control module 826. The operational processing and control of the centrifugal gas compressor 700 and the compressor driver 600 may be performed using a compressor control module 825 and a driver control module 826 on a dedicated core of the multi-core processor 870, such as a fourth core 874, or may be divided amongst numerous cores of the multi-core processor 870.

In addition, the method 900 may include interactions between the bearing control modules, the compressor control module 825, and the driver control module 826 within the computer 810. In particular, the bearing control modules/control modules may communicate with each other, for example, feedback and/or control commands may be shared amongst the control modules. Also, the control modules may incorporate data from another module in its own operational processing and control functions, for example, shared feedback and/or control commands from one bearing control module/control module may be used to modify commands of another bearing control module/control module. Also, the bearing control modules/control modules may be dynamically adjusted, for example, the shared feedback and/or control commands from a first bearing control module/control module may be used to modify control algorithms of a second bearing control module/control module.

In step 940, the computer 810 digitally communicates the bearing control commands to the bearing I/O terminal 840. In particular, the communication device 813 may transmit digital control commands from each bearing control module to bearing I/O terminal 840 via the communication link 830, similar to the digital communications of step 920.

In step 942, the computer 810 may selectively communicate data, communicating the different classes of data separately, similar to the selective communications of step 922 (e.g., at separate times). In addition, step 942 may include creating and/or identifying one or more classes of data as discussed above. Also, the communication device 813 may communicate as an EtherCAT master controller, whereas the communication device 843 of the bearing I/O terminal 840 may communicate as an EtherCAT master slave device. According to one embodiment, digitally communicating the bearing control command to the bearing I/O terminal 840 may include selectively communicating the bearing control command.

In step 950, the bearing I/O terminal 840 transmits the bearing control command to the corresponding power amplifier 638, 738. In particular, the bearing I/O terminal 840 may then convert the bearing control command to voltage levels corresponding to a predetermined power level of the corresponding magnetic bearing. For example, the communication device 843 may receive the bearing control command transmitted across the communication link 830, and communicate the bearing control command to I/O device 842. The I/O device 842 may then issue the bearing control command to the corresponding power amplifier 638, 738. In addition, at step 952, the I/O device 842 may convert any digital bearing control commands to analog control command as required, similar to step 912.

A computer 810 including a multi-core processor 870 may improve on the current DSP controllers, as the computer 810 including the multi-core processor 870 may have superior performance, flexibility, memory, applications/features, support, human-to-machine interface (HMI), etc. Moreover, the computer 810 including the multi-core processor 870 may be user-modified by reprogramming software via a conventional user interface. In addition, once the magnetic bearings are controlled by the computer 810 including the multi-core processor 870, synergistic benefits may be realized. In particular, the entire compressor system (centrifugal gas compressor, the compressor driver, and magnetic bearing) may reside on the same platform. Accordingly, the control system could be designed so the compressor, magnetic bearing, and engine or motor all share the same electric power supply and UPS.

Those of skill will appreciate that the various illustrative logical blocks, modules, and algorithm steps described in connection with the embodiments disclosed herein can be implemented as electronic hardware, computer software, or combinations of both. To clearly illustrate this interchangeability of hardware and software, various illustrative components, blocks, modules, and steps have been described above generally in terms of their functionality. Whether such functionality is implemented as hardware or software depends upon the design constraints imposed on the overall system. Skilled persons can implement the described functionality in varying ways for each particular application, but such implementation decisions should not be interpreted as causing a departure from the scope of the invention. In addition, the grouping of functions within a module, block, or step is for ease of description. Specific functions or steps can be moved from one module or block without departing from the invention.

The preceding detailed description is merely exemplary in nature and is not intended to limit the invention or the application and uses of the invention. The described embodiments are not limited to use in conjunction with a particular type or combination of driver and driven machine. For example, the driver may be an electric motor, a gas turbine engine, a reciprocating engine, or other rotating machine. Also for example the driven machine may be a gas compressor, a generator, or other rotatingly driven machine. Hence, although the present embodiments are, for convenience of explanation, depicted and described as being implemented in a centrifugal gas compressor driven by an electric motor, it will be appreciated that it can be implemented in various other types of drivers and driven machines, and in various other systems and environments. Furthermore, there is no intention to be bound by any theory presented in any preceding section. It is also understood that the illustrations may include exaggerated dimensions and graphical representation to better illustrate the referenced items shown, and are not consider limiting unless expressly stated as such.

What is claimed is:

1. A method for controlling a gas compressor, the gas compressor having a compressor driver, the method comprising:

communicating feedback data about two magnetic bearings to a computer via a communication link, the computer including a multi-core processor and two bearing control modules;

processing the feedback data about the two magnetic bearings where the feedback data for each of the two magnetic bearings is processed by different bearing control modules on separate cores of the multi-core processor in parallel and issuing a bearing control command to each of the two magnetic bearings in response to the feedback data;

communicating bearing control commands to the two magnetic bearings from the computer via the communication link; and providing operational processing and control of the gas compressor with a compressor control module of the computer and providing operational processing and control of the compressor driver with a driver control module of the computer on a third core of the multi-core processor in parallel with processing the feedback data about the two magnetic bearings.

2. The method of claim 1, further comprising processing the feedback data about a third magnetic bearing with a third bearing control module of the computer on a third core of the multi-core processor in parallel with processing the feedback data about the two magnetic bearings.

3. The method of claim 2, further comprising:

providing operational processing and control of the gas compressor with a compressor control module of the computer and providing operational processing and control of the compressor driver with a driver control module of the computer on a fourth core of the multi-core processor in parallel with processing the feedback data about the two magnetic bearings; and processing the feedback data about a fourth magnetic bearing with a fourth bearing control module on one or more cores of the multi-core processor.

4. The method of claim 3, wherein the two magnetic bearings and the third magnetic bearing are radial bearings, and the fourth magnetic bearing is a thrust bearing.

5. The method of claim 3, wherein the two bearing control modules, the third bearing control module, and the fourth bearing control module each receives the feedback data about the two magnetic bearings, the third magnetic bearing, and the fourth magnetic bearing.

6. The method of claim 1, further comprising:

receiving the feedback data in a bearing input/output terminal; and transmitting the bearing control commands from the bearing input/output terminal to a magnetic bearing driver;

wherein the communicating feedback data about the two magnetic bearings to the computer via the communication link includes digitally communicating the feedback data from the bearing input/output terminal to the computer via the communication link;

wherein the communicating the bearing control commands to the two magnetic bearings from the computer via the communication link includes digitally communicating each of the bearing control commands from the computer to the bearing input/output terminal via the communication link; and wherein the feedback data about the two magnetic bearings to the computer and the bearing control commands from the computer to the bearing input/output terminal are selectively communicated on separate paths.

7. A method for controlling a gas compressor, the gas compressor having a compressor driver, the method comprising:

communicating first feedback data about a first magnetic bearing to a computer and second feedback data about a second magnetic bearing to the computer via a communication link, the computer including a multi-core processor, a first bearing control module, and a second bearing control module;

processing the first feedback data with the first bearing control module on a first core of the multi-core processor and processing the second feedback data with the second bearing control module on a second core of the multi-core processor in parallel to the processing of the first feedback data with the first bearing control module, and issuing a first bearing control command from the first bearing control module for the first magnetic bearing and a second bearing control command from the second bearing control module for the second magnetic bearing;

communicating the first bearing control command to the first magnetic bearing and the second bearing control command to the second magnetic bearing from the computer via the communication link; and providing operational processing and control of the gas compressor with a compressor control module of the computer and providing operational processing and control of the compressor driver with a driver control module of the computer on a third core of the multi-core processor in parallel with the processing of the first feedback data and the second feedback data.

8. The method of claim 7, wherein providing operation processing and control of the compressor driver includes measuring a rotational speed and a rotational direction of the compressor driver with a driver sensing system including a first driver sensor and a second driver sensor radially spaced apart such that a first angle between the first driver sensor and the second driver sensor is not equal to a second angle between the first driver sensor and the second driver sensor.

9. The method of claim 7, further comprising:

processing third feedback data about a third magnetic bearing with a third bearing control module of the computer on a third core of the multi-core processor in parallel with the processing of the first feedback data and the second feedback data, and issuing a third bearing control command from the third bearing control module for the third magnetic bearing; and communicating the third bearing control command to the third magnetic bearing from the computer via the communication link.

10. The method of claim 9, further comprising:

providing operational processing and control of the gas compressor with a compressor control module of the computer and providing operational processing and control of the compressor driver with a driver control module of the computer on a fourth core of the multi-core processor in parallel with the processing of the first feedback data, the second feedback data, and the third feedback data.

11. The method of claim 10, further comprising:

processing fourth feedback data about a fourth magnetic bearing with a fourth bearing control module of the computer on one or more of the first core, the second core, the third core and the fourth core, and issuing a fourth bearing control command from the fourth bearing control module for the fourth magnetic bearing; and communicating the fourth bearing control command to the fourth magnetic bearing from the computer via the communication link.

12. The method of claim 11, wherein the first magnetic bearing, the second magnetic bearing, and the third magnetic bearing are radial bearings; and wherein the fourth magnetic bearing is a thrust bearing.

13. The method of claim 11, wherein the first bearing control module, the second bearing control module, the third bearing control module, and the fourth bearing control module each receives the first feedback data, the second feedback data, the third feedback data, and the fourth feedback data.

14. A control system for a centrifugal gas compressor, the centrifugal gas compressor including a compressor driver and a magnetic bearing system including a first magnetic bearing and a second magnetic bearing, the control system comprising:

a bearing input/output terminal including an input/output device, the input/output device configured to receive signals from a first sensor of the first magnetic bearing and a second sensor of the second magnetic bearing, and to transmit control commands to a first magnetic bearing driver of the first magnetic bearing and a second magnetic bearing driver of the second magnetic bearing; and a computer including a multi-core processor including a first core, a second core, a third core, and a fourth core, a first bearing control module configured to process a first feedback signal from the first sensor on the first core and issue a first bearing control command to the first magnetic bearing driver, a second bearing control module configured to process a second feedback signal from the second sensor on the second core and issue a second bearing control command to the second magnetic bearing driver in parallel to the first bearing control module, a third bearing control module configured to process a third feedback signal from a third sensor on the third core and issue a third bearing control command to a third magnetic bearing driver for a third magnetic bearing of the magnetic bearing system, a compressor control module configured to provide operational processing and control of the centrifugal gas compressor on a third core, a driver control module configured to provide operational processing and control of the compressor driver on the third core, and a fourth bearing control module configured to process a fourth feedback signal from a fourth sensor on one or more of the first core, the second core, the third core, and the fourth core, and issue a fourth bearing control command to a fourth magnetic bearing driver for a fourth magnetic bearing of the magnetic bearing system.

15. The control system of claim 14, wherein the first magnetic bearing, the second magnetic bearing, and the third magnetic bearing are radial bearings; and wherein the fourth magnetic bearing is a thrust bearing.

16. The control system of claim 15, wherein the fourth magnetic bearing and one of the first magnetic bearing, the second magnetic bearing, and the third magnetic bearing are within a single bearing housing forming a combination bearing.

* * * * *